US011150030B2

(12) United States Patent
Kishimoto et al.

(10) Patent No.: US 11,150,030 B2
(45) Date of Patent: Oct. 19, 2021

(54) VAPOR CHAMBER

(71) Applicant: Murata Manufacturing Co., Ltd., Nagaokakyo (JP)

(72) Inventors: Atsushi Kishimoto, Nagaokakyo (JP); Norikazu Kume, Nagaokakyo (JP); Haruhiko Ikeda, Nagaokakyo (JP); Takuo Wakaoka, Nagaokakyo (JP); Osamu Chikagawa, Nagaokakyo (JP); Tatsuhiro Numoto, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 286 days.

(21) Appl. No.: 16/414,802

(22) Filed: May 17, 2019

(65) Prior Publication Data

US 2019/0271511 A1 Sep. 5, 2019

Related U.S. Application Data

(63) Continuation-in-part of application No. PCT/JP2018/016936, filed on Apr. 26, 2018.

(30) Foreign Application Priority Data

Apr. 28, 2017 (WO) ..... PCT/JP2017/017035
Sep. 29, 2017 (JP) ..... JP2017-190718

(51) Int. Cl.
*F28D 15/04* (2006.01)
*F28D 15/02* (2006.01)

(52) U.S. Cl.
CPC ..... *F28D 15/04* (2013.01); *F28D 15/02* (2013.01)

(58) Field of Classification Search
CPC ..... F28F 3/12; F28F 2240/00; F28D 15/04; F28D 15/02; H05K 7/20336
See application file for complete search history.

(56) References Cited

U.S. PATENT DOCUMENTS 3,680,189 A * 8/1972 Noren ..... B21D 53/02 29/890.032
5,465,782 A 11/1995 Sun et al.
(Continued)

FOREIGN PATENT DOCUMENTS

CN 203704739 U 7/2014
JP 3062459 U 10/1999
(Continued)

OTHER PUBLICATIONS

Written Opinion of the International Searching Authority issued for PCT/JP2018/016936, dated Jul. 10, 2018.
(Continued)

*Primary Examiner* — Tho V Duong
(74) *Attorney, Agent, or Firm* — Arent Fox LLP

(57) ABSTRACT

A vapor chamber includes a housing including first and second sheets that face each other and that include respective outer edge portions joined to each other, supports that support the first and second sheets from inside and that are disposed therebetween, and a hydraulic fluid enclosed in the housing. The first and second sheets do not include an angled portion having an angle of about 90° or less between a joint and a support nearest to the joint. The expression $0.02 \leq b/a \leq 0.3$ is satisfied, where a is a distance from an outer edge of the outermost support to an inner edge of the joint between the first and second sheets, and b is a distance between the first and second sheets at the outer edge of the outermost support.

19 Claims, 5 Drawing Sheets

(56) References Cited

U.S. PATENT DOCUMENTS

| | | | | |
|---|---|---|---|---|
| 5,642,776 | A | 7/1997 | Meyer, IV et al. | |
| 2002/0056542 | A1* | 5/2002 | Yamamoto | F28D 15/0233 165/80.3 |
| 2003/0136551 | A1* | 7/2003 | Bakke | F28D 15/0233 165/104.26 |
| 2006/0196640 | A1 | 9/2006 | Siu | |
| 2009/0025910 | A1 | 1/2009 | Hoffman et al. | |
| 2009/0040726 | A1* | 2/2009 | Hoffman | F28D 15/0233 361/700 |
| 2010/0018678 | A1 | 1/2010 | Siu | |
| 2011/0232876 | A1* | 9/2011 | Chang | F28D 15/0233 165/104.26 |
| 2013/0025829 | A1 | 1/2013 | Huang | |
| 2015/0060022 | A1* | 3/2015 | Sun | F28D 15/04 165/104.26 |
| 2015/0077929 | A1 | 3/2015 | Honmura et al. | |
| 2017/0138673 | A1 | 5/2017 | Aoki et al. | |

FOREIGN PATENT DOCUMENTS

| | | | |
|---|---|---|---|
| JP | 2007107870 | A | 4/2007 |
| JP | 2007212028 | A | 8/2007 |
| JP | 2008522129 | A | 6/2008 |
| JP | 2015059693 | A | 3/2015 |
| JP | 2016035348 | A | 3/2016 |
| WO | 2016017471 | A1 | 2/2016 |

OTHER PUBLICATIONS

International Search Report issued for PCT/JP2018/016936, dated Jul. 10, 2018.

* cited by examiner

Ultrasonic inspection observation result

VAPOR CHAMBER

CROSS REFERENCE TO RELATED APPLICATIONS

This application claims the benefit of priority to PCT/JP2017/017035 filed on Apr. 28, 2017 and Japanese Patent Application No. 2017-190718 filed on Sep. 29, 2017, and is a Continuation-in-Part Application of PCT Application No. PCT/JP2018/016936 filed on Apr. 26, 2018. The entire contents of each of these applications are hereby incorporated herein by reference.

BACKGROUND OF THE INVENTION

1. Field of the Invention

The present invention relates to a vapor chamber.

2. Description of the Related Art

In recent years, calorific value has been increasing because of high integration and high performance of elements. In addition, the size of products has been decreasing, and heat generation density has been increasing. Accordingly, a heat dissipation countermeasure becomes important. This situation is particularly pronounced in the field of mobile terminals, such as a smart phone and a tablet. For example, a graphite sheet is frequently used as a member for heat countermeasure. However, the amount of heat transferred by the sheet is insufficient, and the use of other members for heat countermeasure is considered. In particular, the use of a vapor chamber, which is a planar heat pipe, is under consideration, because the vapor chamber is able to very effectively transfer heat.

The vapor chamber is provided with a wick for transferring a hydraulic fluid by capillary action in a housing, and the hydraulic fluid is enclosed therein. The hydraulic fluid absorbs heat from a heating element at an evaporation portion at which the heat from the heating element is absorbed, evaporates in the vapor chamber, moves to a condensation portion, and turns back into the liquid phase by being cooled. The hydraulic fluid that has turned back into the liquid phase moves again toward the heating element (evaporation portion) by the capillary action of the wick, and cools the heating element. By repeating this cycle, the vapor chamber, which has no external power, is able to operate independently and diffuse heat two-dimensionally at high speed by using the latent heat of evaporation and the latent heat of condensation of the hydraulic fluid.

Japanese Unexamined Patent Application Publication No. 2016-35348 discloses a vapor chamber that includes a housing having a hollow and formed by two opposing plates, a projecting portion formed on a central portion, a hydraulic fluid enclosed in the hollow, a wick structure formed in the hollow, and an outer circumferential portion of the projecting portion sealed by laser welding. Japanese Unexamined Patent Application Publication No. 2015-59693 discloses a vapor chamber that includes a container that is sealed by stacking two or more etched metal sheets and joining at least a portion of an outer circumferential portion thereof, the outer circumferential portion of the container formed by diffusion-jointing the side wall of each metal sheet, and the width of the side wall is 0.3 mm or more.

It is necessary to perform, for example, a process of forming each metal sheet for forming the housing into a projecting shape or a process of forming a groove on the sheet before an interior space of the housing is formed in the vapor chambers disclosed in Japanese Unexamined Patent Application Publication No. 2016-35348 and Japanese Unexamined Patent Application Publication No. 2015-59693. The inventors of preferred embodiments of the present invention tried to ensure an interior space of a housing by providing a support between two sheets for forming the housing, and none of the above processes was performed on the metal sheets before the interior space of the housing was formed. However, it was discovered that the reliability of some vapor chambers thus obtained is poor.

SUMMARY OF THE INVENTION

Preferred embodiments of the present invention provide vapor chambers that each include a housing including two sheets and a support disposed therebetween and that has high reliability.

The inventors of preferred embodiments of the present invention have conducted extensive research on increasing the reliability of the vapor chamber that includes the housing including the two sheets and the support disposed therebetween. As a result, the inventors of preferred embodiments of the present invention have discovered that adjustment of an angle between the two sheets near a joint enables the vapor chamber to have high reliability.

A vapor chamber according to a preferred embodiment of the present invention includes a housing including a first sheet and a second sheet that face each other and that include respective outer edge portions joined to each other, supports that support the first sheet and the second sheet from inside the first sheet and the second sheet and that are disposed therebetween, and a hydraulic fluid that is enclosed in the housing. The first sheet and the second sheet do not include an angled portion having an angle of about 90° or less between a joint and the support nearest to the joint. The following expression (1) is satisfied: $0.02 \leq b/a \leq 0.3$ (1), where a is a distance (mm) from an outer edge of the outermost support to an inner edge of the joint between the first sheet and the second sheet, and b is a distance (mm) between the first sheet and the second sheet at the outer edge of the outermost support.

A heat dissipation device according to a preferred embodiment of the present invention includes a vapor chamber according to a preferred embodiment of the present invention.

An electronic device according to a preferred embodiment of the present invention includes a vapor chamber or a heat dissipation device according to a preferred embodiment of the present invention.

In the vapor chamber that uses the housing including the two sheets and the support disposed therebetween, an angle between the two sheets near the joint is adjusted. What is specifically adjusted is the relationship between the distance from the inner edge of the joint and the support nearest to the joint and the distance between the first sheet and the second sheet at the position at which the support nearest to the joint is located. This enables the reliability of the vapor chamber to be increased. In addition, the structure according to preferred embodiments of the present invention enables the vapor chamber that has high reliability to be readily manufactured.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Vapor chambers according to preferred embodiments of the present invention will hereinafter be described in detail with reference to the accompanying drawings.

Figure 1:
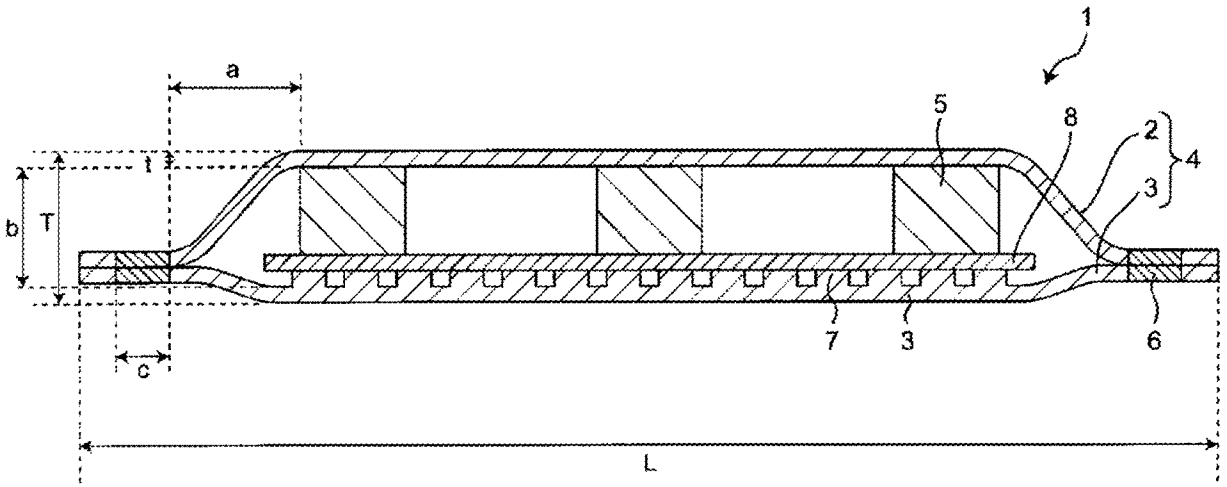
FIG. 1 is a schematic sectional view of a vapor chamber 1 according to a preferred embodiment of the present invention.
Figure 2:
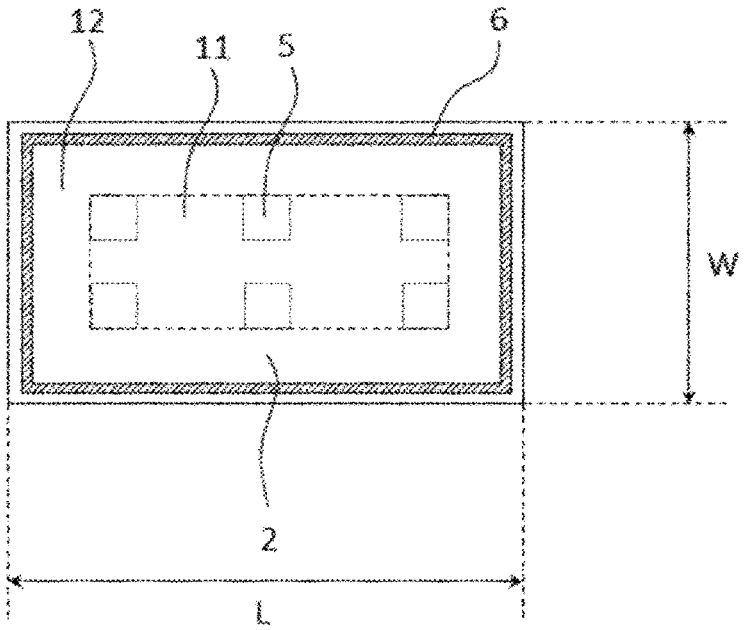
FIG. 2 is a schematic plan view of the vapor chamber 1 viewed from the front of a first sheet.

As illustrated in FIG. 1 and FIG. 2, a vapor chamber 1 according to a preferred embodiment includes a housing 4 including a first sheet 2 and a second sheet 3 that face each other and a hydraulic fluid (not illustrated) that is enclosed therein. In order to ensure an interior space of the housing 4, supports 5 that support the first sheet 2 and the second sheet 3 from inside the first sheet 2 and the second sheet 3 are disposed therebetween. In a region 11 (also referred to below as a "central region") that encompasses the supports 5 located near edges, the first sheet 2 and the second sheet 3 are supported by the supports 5 and spaced from each other by a predetermined distance. The first sheet 2 and the second sheet 3 approach each other in a region 12 (also referred to below as a "peripheral region") outside the central region 11 and are in contact with each other, joined to each other, and sealed along an outer edge portion. A portion 6 along which the first sheet and the second sheet are joined to each other and is also referred to as a "joint". In other words, the first sheet 2 and the second sheet 3 typically begin to approach from an edge of the support 5 nearest to the corresponding edge of each sheet and are joined to each other and sealed along the joint 6 extending along the outer edge portion of the sheet. The second sheet 3 includes projections 7 on the inner surface thereof (that is, a main surface of the housing that faces the interior space). A wick 8 is disposed on the second sheet 3. That is, in the vapor chamber 1 according to the present preferred embodiment, the wick 8 is located on the second sheet 3, the supports 5 are located on the wick 8, and the first sheet 2 is located on the supports 5.

The housing 4 includes the first sheet 2 and the second sheet 3 that face each other.

The size of the housing 4 (that is, the vapor chamber) is not particularly limited. The thickness (illustrated by T in FIG. 1) of the housing 4 is preferably, for example, no less than about 100 μm and no more than about 600 μm, more preferably, no less than about 200 μm and no more than about 500 μm. The length (illustrated by L in FIG. 1) and the width (illustrated by W in FIG. 2) of the housing 4 is appropriately determined depending on use and may preferably be, for example, no less than about 5 mm and no more than about 500 mm, no less than about 20 mm and no more than about 300 mm, or no less than about 50 mm and no more than about 200 mm.

The shape of the housing 4 is not particularly limited. For example, the planar shape (the shape illustrated in FIG. 2, that is, the shape viewed from above in FIG. 1) of the housing 4 may preferably be a polygonal shape, such as a triangle or a rectangle, a circular shape, an ellipse shape, or a combination thereof.

The materials of the first sheet 2 and the second sheet 3 are not particularly limited provided that the materials have characteristics suitable for the vapor chamber, for example, being thermally conductive, strong, and flexible. The materials of the first sheet 2 and the second sheet 3 are preferably metals, such as copper, nickel, aluminum, magnesium, titanium, iron, or an alloy containing these as a main component, for example, and are particularly preferably copper, for example. The materials of the first sheet 2 and the second sheet 3 may be the same or may differ from each other but are preferably the same.

The thicknesses (illustrated by t in FIG. 1) of the first sheet 2 and the second sheet 3 are not particularly limited but are preferably, for example, no less than about 10 μm and no more than about 200 μm, more preferably no less than about 30 μm and no more than about 100 μm, and even more preferably no less than about 40 μm and no more than about 60 μm. The thicknesses of the first sheet 2 and the second sheet 3 may be the same or may differ from each other. The thickness of each of the first sheet 2 and the second sheet 3 may be the same over the entire or substantially the entire length, or the thickness of a portion thereof may be less than that of another portion thereof. According to the present preferred embodiment, the thicknesses of the first sheet 2 and the second sheet 3 are preferably the same. According to another preferred embodiment of the present invention, the thickness of each of the first sheet 2 and the second sheet 3 is preferably the same over the entire or substantially the entire length.

According to the present preferred embodiment, the second sheet 3 includes the projections 7 on the main surface facing the interior space. The projections enable the sheet to hold the hydraulic fluid between the projections and enable the vapor chamber according to the present preferred embodiment to have an increased transmittance. The increase in the transmittance improves the ability of the vapor chamber to transfer heat. Each projection means a portion having a height greater than that of an adjacent portion, and includes a portion having a relatively large height as a result of a recessed portion, such as a groove, being provided on the main surface in addition to a portion projecting from the main surface.

The height of each projection 7 is not particularly limited but is preferably, for example, no less than about 1 μm and no more than about 100 μm, more preferably no less than about 5 μm and no more than about 50 μm, and even more preferably no less than about 15 μm and no more than about 30 μm. The amount of the hydraulic fluid to be held can be increased by increasing the height of the projection. A space in which vapor of the hydraulic fluid moves can be widened by decreasing the height of the projection. Accordingly, the ability of the vapor chamber to transport heat and the ability thereof to diffuse heat can be adjusted by adjusting the height of the projection.

The distance between the projections 7 is not particularly limited but is preferably no less than about 1 μm and no more than about 500 μm, more preferably no less than about 5 μm and no more than about 300 μm, and even more preferably no less than about 15 μm and no more than about 150 μm. The capillary action is increased by decreasing the distance between the projections. The transmittance is able to be increased by increasing the distance between the projections.

The shape of each projection 7 is not particularly limited but may preferably be a columnar shape, a prismatic shape, a truncated cone shape, a truncated pyramid shape, or another suitable shape. The shape of the projection 7 may be a wall shape, that is, a shape such that a groove is provided between the projection and the projection adjacent thereto.

The projections 7 may be integral with the first sheet 2 or the second sheet 3, or may be manufactured separately from the first sheet 2 and the second sheet 3 and may be subsequently secured to a predetermined location.

The projections 7 are not essential components for the vapor chambers according to preferred embodiments of the present invention and may not be provided.

According to the present preferred embodiment, the first sheet 2 or the second sheet 3 or both include the projections 7, and each of the projections 7 include a microstructure on a surface thereof. The projections 7, each of which includes the microstructure on the surface thereof, exert the capillary action on the surface thereof and enable the hydraulic fluid to be transferred. That is, the projections 7 themselves define and function as the wick. Consequently, the ability of the vapor chamber to transfer heat is improved.

Since the projections 7 themselves are able to define function as the wick, the vapor chamber according to the present preferred embodiment does not need another wick other than the projections. Accordingly, a vapor chamber provided according to a preferred embodiment of the present invention includes the projections 7, each of which includes the microstructure that defines and functions as the wick on the surface thereof, and does not include another wick other than the projections 7.

The "microstructure" means a structure including protruding shapes and/or recessed shapes disposed at regular intervals, where the height of each protruding shape and the depth of each recessed shape are preferably no less than about 10 nm and no more than about 10,000 nm, for example, and the width of the protruding shape and the recessed shape is preferably no less than about 10 nm and no more than about 10,000 nm, for example. The protruding shapes mean a structure in which there are projections, the recessed shapes mean a structure in which there are recesses, and the projections and the recesses may have the same shape or may have different shapes. For example, the microstructure may include a structure in which columns or prisms are provided, a structure in which grooves are provided, or a structure in which semi-circular projections or semi-elliptical projections are provided. The microstructure may have a regular structure or an irregular structure.

Figure 3:
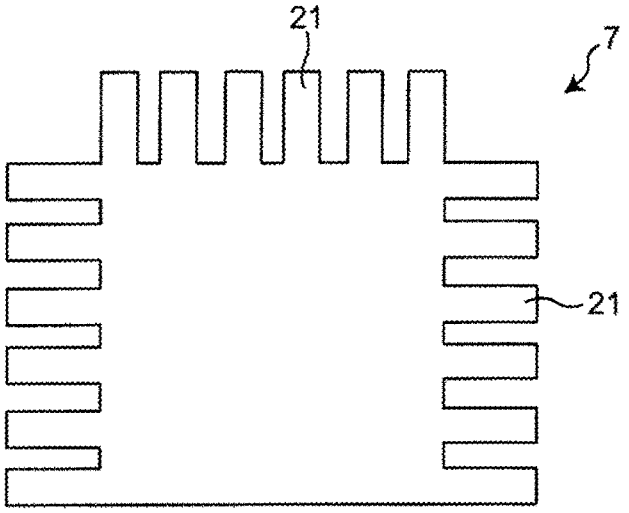
FIG. 3 is a schematic sectional view of a projection that has a microstructure according to a preferred embodiment of the present invention.

As illustrated in, for example, FIG. 3, an example of the projection that includes the microstructure include a projection that includes prismatic projections 21 provided on a surface thereof. The heights, thicknesses, and directions of the prismatic projections 21, and the distances between the adjacent prismatic projections 21, for example, may be the same or may differ from each other. The projection that includes the microstructure may be formed by micromachining, such as laser processing, for example.

Figure 4:
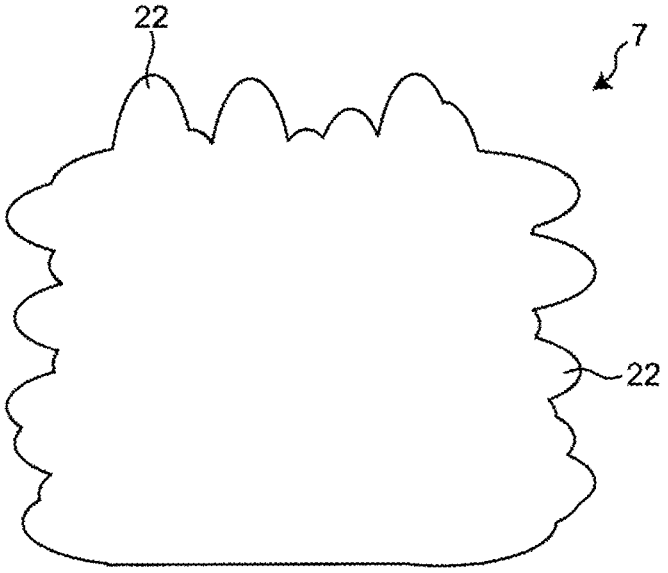
FIG. 4 is a schematic sectional view of a projection that has a microstructure according to a preferred embodiment of the present invention.

As illustrated in FIG. 4, another example of the projection that includes the microstructure is a projection that includes rounded (spherical) projections 22 provided on a surface thereof. The heights, thicknesses, and directions of the rounded projections 22, and the distances between the adjacent rounded projections 22, for example, may be the same or may differ from each other. The projection that includes the microstructure may be obtained, for example, by forming projections each including a smooth surface and subsequently immersing the projections in an etching solution.

Figure 5:
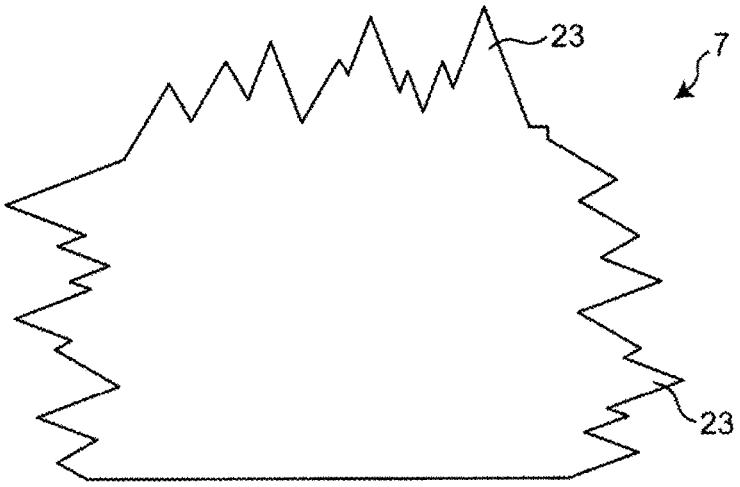
FIG. 5 is a schematic sectional view of a projection that has a microstructure according to a preferred embodiment of the present invention.

As illustrated in FIG. 5, another example of the projection that includes the microstructure is a projection that includes pointed (pyramid-shaped) projections 23. The heights, thicknesses, taper angle, and directions of the pointed projections 23, and the distances between the adjacent pointed projections 23, for example, may be the same or may differ from each other. The projection that includes the microstructure may be obtained, for example, by forming projections each including a smooth surface and subsequently immersing the projections in an etching solution or plating the projections. In the case in which etching is used, the size and shape of each pointed projection 23 may be relatively uniform. In the case in which plating is used, the thickness of the pointed projection 23 and, for example, the taper angle may be decreased.

Figure 6:
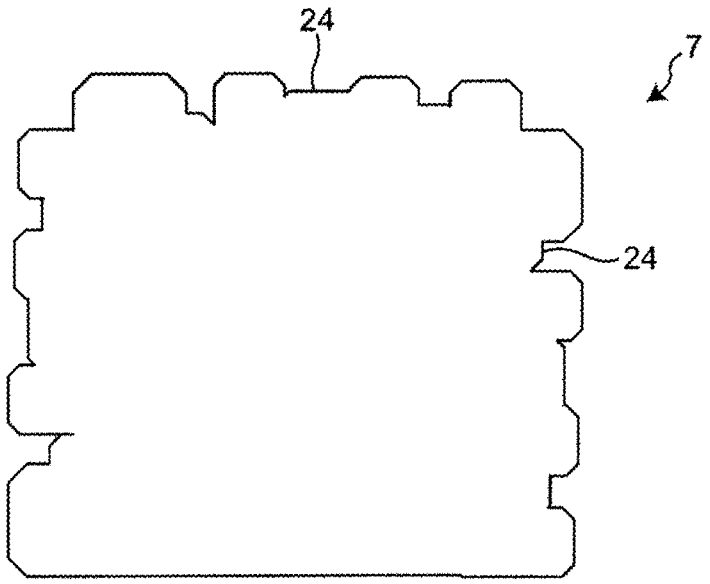
FIG. 6 is a schematic sectional view of a projection that has a microstructure according to a preferred embodiment of the present invention.

As illustrated in FIG. 6, another example of the projection that includes the microstructure is a projection that includes recesses 24 provided on a surface thereof. The shapes of the recesses 24 including the depths and the widths may be the same or may differ from each other. The projection that includes the microstructure may be obtained, for example, by forming projections each including a smooth surface and subsequently performing physical treatment, such as sandblasting.

The outer edge portion of the first sheet 2 and the outer edge portion of the second sheet 3 are joined to each other. For example, the joining method may be, but is not particularly limited to, laser welding, resistance welding, diffusion jointing, braze welding, TIG welding (tungsten-inert gas welding), ultrasonic bonding, or resin sealing and is preferably the laser welding, the resistance welding, or the braze welding, for example.

The supports 5 support the first sheet 2 and the second sheet 3 from inside the first sheet 2 and the second sheet 3, such that the distance between the first sheet and the second sheet is a predetermined distance. The supports 5 that are disposed inside the housing 4 prevent the housing from deforming, for example, when the pressure in the housing is decreased or an external pressure is applied from the outside of the housing. The supports may support the first sheet and the second sheet with the supports in direct contact with the first sheet and the second sheet or with another member, such as a wick, for example, interposed therebetween.

For example, the material of each support 5 may be, but is not particularly limited to, a metal, such as copper, nickel, aluminum, magnesium, titanium, iron, or an alloy containing these as a main component, and is preferably copper, for example. According to a preferred embodiment of the present invention, the material of the support is the same as the material of the first sheet or the material of the second sheet or both.

The height of each support 5 is more than the height of each projection 7. According to the present preferred embodiment, the height of the support 5 is preferably, for example, no less than about 1.5 times the height of the projection 7 and no more than about 100 times the height of the projection 7, more preferably no less than about 2 times the height of the projection 7 and no more than about 50 times the height of the projection 7, further more preferably no less than about 3 times the height of the projection 7 and no more than about 20 times the height of the projection 7, and even more preferably no less than about 3 times the height of the projection 7 and no more than about 10 times the height of the projection 7.

The height of the support 5 may be appropriately determined depending on the desired thickness of the vapor chamber, is, for example, preferably no less than about 50 μm and no more than about 500 μm, more preferably no less than about 100 μm and no more than about 400 μm, further more preferably no less than about 100 μm and no more than about 200 μm, and even more preferably no less than about 125 μm and no more than about 150 μm. The height of the support means a height in the thickness direction of the vapor chamber (height in the vertical direction in FIG. 1).

The heights of the supports 5 of the vapor chamber may be the same or may differ from each other. For example, the height of the support 5 in a region may differ from the height of the support 5 in another region. In the case in which the height of the support 5 in a region is changed, the thickness of the vapor chamber may be partially changed.

The shape of each support 5 is not particularly limited but may be a columnar shape, a prismatic shape, a truncated cone shape, a truncated pyramid shape, or another shape, for example.

The thickness of each support 5 is not particularly limited provided that the support 5 has a strength that enables the housing of the vapor chamber to be prevented from deforming. For example, the diameter of a substantially circular section of the support in a direction perpendicular or substantially perpendicular to the height direction may be no less than about 100 μm and no more than about 2000 μm, and preferably no less than about 300 μm and no more than about 1000 μm. The housing of the vapor chamber may be further prevented from deforming by increasing the diameter of the substantially circular section of the support. The space in which vapor of the hydraulic fluid moves may be widened by decreasing the diameter of the substantially circular section of the support.

The arrangement of the supports 5 is not particularly limited but the supports 5 are preferably arranged at regular intervals, for example, in a lattice pattern such that the distance between the supports is constant or substantially constant. The supports that are arranged at regular or substantially regular intervals enable uniform or substantially uniform strength to be ensured over the entire vapor chamber.

The number of the supports 5 and the distance between the supports 5 are not particularly limited but the number is preferably no less than about 0.125 and no more than about 0.5, more preferably no less than about 0.2 and no more than about 0.3 per area (square millimeter) of the main surface of each sheet that defines the interior space of the vapor chamber. The vapor chamber (or the housing) may be further prevented from deforming by increasing the number of the supports. The space in which vapor of the hydraulic fluid moves may be widened by decreasing the number of the supports.

The supports 5 may be formed integrally with the first sheet, or may be manufactured separately from the first sheet and may be subsequently secured to a predetermined location of the first sheet.

The wick 8 is not particularly limited provided that the wick is able to move the hydraulic fluid by the capillary action. A capillary structure that exerts the capillary action to move the hydraulic fluid is not particularly limited and may be a known structure used in an existing vapor chamber. Examples of the capillary structure include a microstructure having unevenness such as narrow holes, grooves, or projections, for example, a fiber structure, a groove structure, or a mesh structure.

The thickness of the wick 8 is not particularly limited but may be, for example, no less than about 5 μm and no more than about 200 μm, preferably no less than about 10 μm and no more than about 80 μm, and more preferably no less than about 30 μm and no more than about 50 μm.

The size and shape of the wick 8 are not particularly limited. However, for example, the wick 8 preferably has a size and a shape that enable the wick 8 to be continuously disposed from an evaporation portion to a condensation portion inside the housing.

The vapor chamber according to the present preferred embodiment includes a single wick. However, the vapor chamber is not limited thereto and may include a plurality of the wicks, for example, two wicks, three wicks, four wicks, five wicks or more.

The wick 8 is not an essential component for the vapor chambers according to preferred embodiments of the present invention and may not be provided. In this case, a surface of the first sheet or a surface of the second sheet or both may be processed to include, for example, unevenness or grooves, and the sheet or the sheets may have define and function as the wick. The supports 5 may come into contact with the first sheet and the second sheet at positions at which there is no wick.

The hydraulic fluid is not particularly limited provided that phase transition between gas and liquid is able to occur in the housing, and examples thereof include water, alcohol, and CFC substitutes. According to the present preferred embodiment, the hydraulic fluid is an aqueous compound, preferably water, for example.

In the vapor chamber 1 according to the present preferred embodiment, the second sheet 3, the wick 8, the supports 5, and the first sheet 2 described above are stacked in this order. The first sheet 2 and the second sheet 3 are closer to each other toward the edges of the sheets in the peripheral region 12 and are in contact with each other, joined to each other, and sealed along the outer edge portion. The portion along which the first sheet and the second sheet are joined to each other is also referred to as the "joint". At least one of the first sheet and the second sheet deforms (curves or bends) so as to approach the other sheet in the peripheral region but does not deform at an angle of about 90° or less, preferably an angle of about 100° or less, and more preferably about 110° or less, for example.

The vapor chamber according to the present preferred embodiment satisfies the following expression (1), where "a" is the distance (mm) from the outer edge of the outermost support to the inner edge of the joint between the first sheet and the second sheet, and "b" is the distance (mm) between the first sheet and the second sheet at the outer edge of the outermost support. The "outermost support" means the support nearest to the joint between the first sheet and the second sheet.

$$0.02 \leq b/a \leq 0.3 \quad (1)$$

When the expression (1) is satisfied, the vapor chamber has high reliability.

According to a preferred embodiment of the present invention, the vapor chamber satisfies the following expression (1').

$$0.06 \leq b/a \leq 0.1 \quad (1')$$

According to this preferred embodiment, the width (illustrated by "c" in FIG. 1) of the joint is preferably about 1 mm or less, more preferably about 0.8 mm or less, and even more preferably about 0.7 mm or less. The width of the joint is preferably about 0.02 mm or more, more preferably about 0.1 mm or more, and even more preferably about 0.2 mm or more.

According to this preferred embodiment, the distance between the first sheet and the second sheet at a position at which the sheets start deforming, which is adjacent to the joint between the first sheet and the second sheet, is preferably about 0.06 mm or more, more preferably about 0.1 mm or more, and even more preferably about 0.2 mm or more. That is, b is preferably about 0.06 or more, and more preferably about 0.1 or more. The distance between the first sheet and the second sheet at the outer edge of the outermost support is preferably about 1 mm or less, more preferably about 0.8 mm or less, and even more preferably about 0.4 mm or less.

The "outer edge of the outermost support" is typically the boundary between the central region 11 and the peripheral region 12. The "distance (mm) from the outer edge of the outermost support to the inner edge of the joint between the first sheet and the second sheet" means the distance from the inner edge of the joint and the support nearest to the joint.

The "distance (mm) between the first sheet and the second sheet at the outer edge of the outermost support" means the distance between the inner main surface of the first sheet and the inner main surface of the second sheet at the outer edge of the outermost support. In the case in which there is a projection or a recessed portion on any one of the inner surfaces, the distance between the inner surfaces of the first sheet and the second sheet is determined with reference to an imaginary surface on which no projection or recessed portion is disposed.

The position of the joint 6 between the first sheet and the second sheet in the height direction (position in the vertical direction in FIG. 1) is not particularly limited provided that the position is between the first sheet and the second sheet in the height direction in the central region 11 (including the case in which the position is equal or substantially equal to the position of the first sheet or the second sheet in the height direction). According to a preferred embodiment of the present invention, the position of the joint 6 in the height direction is the middle position between the first sheet and the second sheet, that is, the distance from the joint to the inner main surface of the first sheet in the height direction in the central region 11 is equal or substantially equal to the distance from the joint to the inner main surface of the second sheet in the height direction in the central region 11.

The vapor chamber according to the present invention is described above with reference to preferred embodiments. The vapor chamber according to the present invention is not limited to the preferred embodiments described and illustrated, and various modifications may be made.

For example, a vapor chamber according to another preferred embodiment may further include projections on the inner main surface of the first sheet 2.

A vapor chamber according to another preferred embodiment may include recessed portions on the inner main surface of the first sheet 2 or the inner main surface of the second sheet 3 or both, instead of the projections.

A vapor chamber according to another preferred embodiment may further include a wick on the first sheet 2. In this case, the supports 5 may not be in direct contact with the first sheet 2 but may support the first sheet 2 with the wick interposed therebetween.

The vapor chambers according to preferred embodiments of the present invention each have high ability to transport heat and high ability to diffuse heat, and are preferably used in heat dissipation devices.

Accordingly, preferred embodiments of the present invention also provide heat dissipation devices that each include a vapor chamber according to a preferred embodiment of the present invention.

The vapor chambers according to preferred embodiments of the present invention advantageously each have a small size (particularly, is thin) and are useful for equipment that needs to have a decreased size, such as an electronic device, for example.

Accordingly, preferred embodiments of the present invention also provide electronic devices that each include a vapor chamber according to a preferred embodiment of the present invention or a heat dissipation device according to a preferred embodiment of the present invention.

EXAMPLES

Example 1

A Cu sheet having a size of about 60 mm×about 110 mm was prepared as the first sheet. The size of the central region was about 26 mm×about 76 mm such that a=about 15 mm was satisfied. In the central region, the supports were formed by etching. Each support was a column having a diameter of about 0.6 mm. The distance (b) between the first sheet and the second sheet was adjusted to a predetermined value (b=about 0.300 mm). Specifically, the height of each support was about 0.230 mm. The supports were disposed in the central region at an interval of about 1.3 mm. The thickness t of the first sheet was about 0.05 mm.

A Cu sheet having a size of about 60 mm×about 110 mm was prepared as the second sheet. The size of the central region was about 26 mm×about 76 mm such that a=about 15 mm was satisfied. In the central region, the projections were formed by etching. Each projection was a quadrangular prism having a bottom surface of about 0.15 mm×about 0.15 mm. The height was about 0.03 mm. The projections were disposed in the central region at an interval of about 0.15 mm. The thickness t of the second sheet was about 0.05 mm.

Meshes having a thickness of about 0.04 mm were used as the wick.

Water was used as the hydraulic fluid.

The first sheet, the second sheet, the wick, and the hydraulic fluid were used to manufacture a vapor chamber in the following manner.

The second sheet, the wick, and the first sheet were stacked in this order from below. Four outer circumferential sides were welded by resistance welding, and the main body of the vapor chamber was manufactured. At this time, the supports formed on the first sheet faced inward, and the projections formed on the second sheet faced inward. The width c of the joint was adjusted to a predetermined value (c=about 0.7 mm) by an electrode width during welding. The position of the joint was adjusted such that the distance a from the outer edge of the outermost support to the inner edge of the joint between the first sheet and the second sheet was a predetermined value (a=about 15 mm). Welding was performed at a position about 1.3 mm inward away from each edge of the first sheet and the second sheet that are stacked such that the width c was about 0.7 mm.

Subsequently, one of the four corners of the main body of the vapor chamber was cut. A Cu pipe was inserted therein. The main body of the vapor chamber and the Cu pipe were secured to each other by soldering. The Cu pipe was connected to a vacuum pump and a syringe that contains the hydraulic fluid with a switching valve interposed therebetween. The switching valve was first operated such that the inside of the vapor chamber and the vacuum pump were in communication with each other to decrease the pressure in the main body of the vapor chamber. Subsequently, the valve was switched such that the inside of the vapor chamber and the syringe that contains the hydraulic fluid were in communication with each other. A predetermined amount of the hydraulic fluid was injected into the inside of the vapor chamber. Subsequently, the Cu pipe was crimped for sealing, and the vapor chamber in the example 1 was obtained.

Vapor chambers in examples 2 to 6 and comparative examples 1 and 2 were manufactured in the same or similar manner as the example 1 except that a, b, and c were values illustrated in the following table.

TABLE 1

| | a (mm) | b (mm) | b/a | c (mm) |
|---|---|---|---|---|
| Example 1 | 15 | 0.3 | 0.02 | 0.7 |
| Example 2 | 5 | 0.3 | 0.06 | 0.7 |
| Example 3 | 3 | 0.3 | 0.1 | 0.7 |
| Example 4 | 1 | 0.3 | 0.3 | 0.7 |
| Example 5 | 3 | 0.3 | 0.1 | 0.06 |
| Example 6 | 1 | 0.3 | 0.3 | 0.06 |
| Comparative Example 1 | 25 | 0.3 | 0.012 | 0.7 |
| Comparative Example 2 | 0.5 | 0.3 | 0.6 | 0.7 |

(Evaluation)

The performance of each vapor chamber manufactured as described above was evaluated by measuring temperature variation characteristics. The temperature variation characteristics were measured as follows. In each of five vapor chambers, a ceramic heater of about 15 mm×about 15 mm was disposed at a position about 10 mm inward away from the center of a short side edge of the vapor chamber. When a calorific value of 3 W was supplied, the difference (ΔT(° C.)) between the temperature of a surface of the vapor chamber opposite the surface on which the ceramic heater was disposed and the temperature of the vapor chamber at a position about 10 mm inward away from the other short side edge was compared. The average value of ΔT is illustrated in Table 2.

The reliability of each vapor chamber manufactured as described above was evaluated by a high temperature storage test in which the vapor chamber was stored at about 105° C. for about 100 hours. The evaluation was made in a manner in which regarding each of five vapor chambers, whether there was a leak before and after the high temperature storage was checked by performing visual inspection and pressing the first sheet and the second sheet at the same time. When there is a leak, an increase in the distance between the first sheet and the second sheet was visually seen. When the first sheet and the second sheet are pressed at the same time, one of the sheets deforms toward the other sheet. In the case in which at least one of these was seen, it was determined that there was a leak. The number of the leaks is illustrated in Table 2.

TABLE 2

| | ΔT (° C.) | Number of Leaks |
|---|---|---|
| Example 1 | 8 | 0/5 |
| Example 2 | 6 | 0/5 |
| Example 3 | 5 | 0/5 |
| Example 4 | 5 | 0/5 |
| Example 5 | 5 | 0/5 |
| Example 6 | 5 | 0/5 |
| Comparative Example 1 | 14 | 0/5 |
| Comparative Example 2 | — | 3/5 |

Portions (a, b, and c) of the vapor chamber may be measured by ultrasonic testing, in addition to direct measurement of a section.

Figure 7:
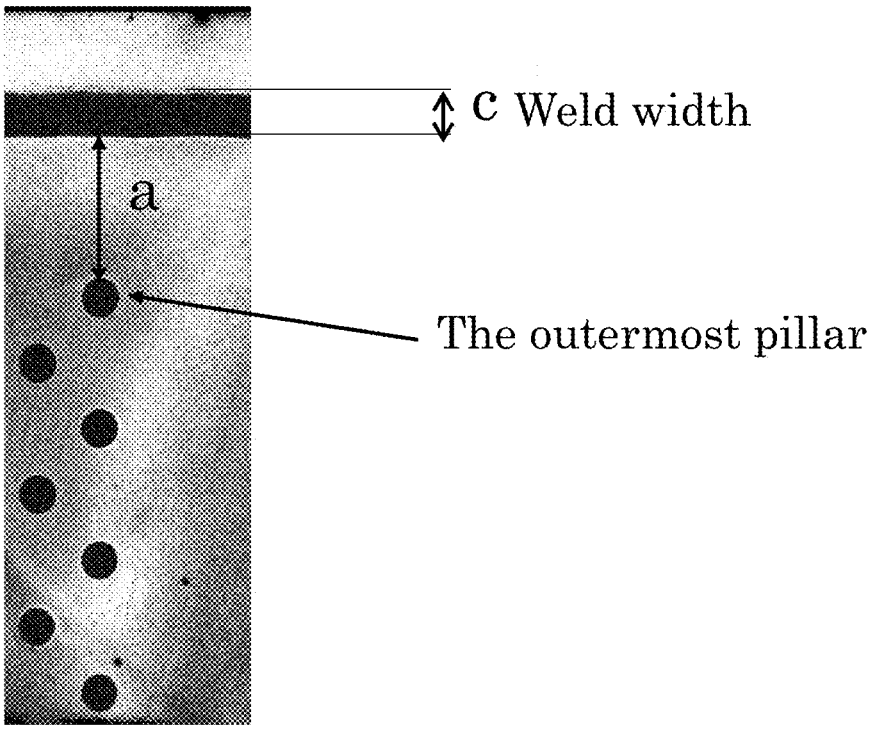
FIG. 7 illustrates a pillar structure observed by ultrasonic testing and viewed from a lower surface.

FIG. 7 illustrates a non-limiting example of a support structure observed by ultrasonic testing and viewed from a lower surface. Conditions for testing in this example are as follows: a testing method is a water immersion method, and the temperature of water is about 40° C. Conditions for a probe are as follows: the probe is driven at a frequency of about 200 MHz, and a focal length is about 2.9 mm. In the case in which testing is performed in the above conditions, the distance a from the outer edge of the outermost support to the inner edge of the joint between the first sheet and the second sheet is illustrated by a in FIG. 7, and a weld width is illustrated by c in FIG. 7. The distance b between the first sheet and the second sheet at the outer edge of the outermost support is calculated by subtracting a thickness of the first and second sheets measured by cross-section observation from a total thickness measured with a micrometer. The portions may be measured in this manner.

The vapor chambers according to preferred embodiment of the present invention each have high reliability and have a wide range of uses. In particular, the vapor chambers may be used, for example, as cooling devices of an electronic device, which require efficient heat transfer and a small size.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vapor chamber comprising:

a housing including a first sheet and a second sheet that face each other and that include respective outer edge portions joined to each other;

a plurality of supports supporting the first sheet and the second sheet from inside the first sheet and the second sheet and that are disposed therebetween; and a hydraulic fluid enclosed in the housing; wherein the first sheet and the second sheet do not include an angled portion having an angle of about 90° or less between a joint at which the first and second sheets are joined and an outermost support of the plurality of supports nearest to the joint; and the expression $0.02 \leq b/a \leq 0.3$ is satisfied, where a is a distance from an outer edge of the outermost support to an inner edge of the joint between the first sheet and the second sheet, and b is a distance between the first sheet and the second sheet at the outer edge of the outermost support.

2. The vapor chamber according to claim 1, wherein a thickness of the first sheet and a thickness of the second sheet are no less than about 10 μm and no more than about 200 μm.

3. The vapor chamber according to claim 1, wherein a width of the joint is about 1.0 mm or less.

4. The vapor chamber according to claim 1, wherein the first sheet and the second sheet are copper sheets.

5. The vapor chamber according to claim 1, further comprising a wick between the first and second sheets.

6. The vapor chamber according to claim 1, wherein at least one of the first sheet and the second sheet includes a projection on at least a portion of an inner surface thereof.

7. The vapor chamber according to claim 6, wherein the projection includes a microstructure provided on a surface thereof.

8. A heat dissipation device comprising:

the vapor chamber according to claim 1.

9. The heat dissipation device according to claim 8, wherein a thickness of the first sheet and a thickness of the second sheet are no less than about 10 μm and no more than about 200 μm.

10. The heat dissipation device according to claim 8, wherein a width of the joint is about 1.0 mm or less.

11. The heat dissipation device according to claim 8, wherein the first sheet and the second sheet are copper sheets.

12. The heat dissipation device according to claim 8, further comprising a wick between the first and second sheets.

13. The heat dissipation device according to claim 8, wherein at least one of the first sheet and the second sheet includes a projection on at least a portion of an inner surface thereof.

14. The heat dissipation device according to claim 13, wherein the projection includes a microstructure provided on a surface thereof.

15. An electronic device comprising:

the vapor chamber according to claim 1.

16. The electronic device according to claim 15, wherein a thickness of the first sheet and a thickness of the second sheet are no less than about 10 μm and no more than about 200 μm.

17. The electronic device according to claim 8, wherein a width of the joint is about 1.0 mm or less.

18. An electronic device comprising:

the heat dissipation device according to claim 8.

19. The electronic device according to claim 18, wherein a thickness of the first sheet and a thickness of the second sheet are no less than about 10 μm and no more than about 200 μm.

* * * * *